US005198605A

United States Patent [19]

Konishi

[11] Patent Number: 5,198,605

[45] Date of Patent: Mar. 30, 1993

[54] KEY TOUCH DATA GENERATION CIRCUIT OF AN ELECTRONIC MUSICAL INSTRUMENT

[75] Inventor: Shinya Konishi, Hamamatsu, Japan

[73] Assignee: Kabushiki Kaisha Kawa Gakki Seisakusho, Shizuoka, Japan

[21] Appl. No.: 774,833

[22] Filed: Oct. 11, 1991

[30] Foreign Application Priority Data

Oct. 12, 1990 [JP] Japan ..... 2-274570

[51] Int. Cl.[5] ..... G10H 1/053; G10H 1/18

[52] U.S. Cl. ..... 84/658; 84/687

[58] Field of Search ..... 84/626, 658, 687-690, 84/DIG. 7, 21, 22

[56] References Cited

U.S. PATENT DOCUMENTS 4,939,973 7/1990 Suzuki ..... 84/626 X

FOREIGN PATENT DOCUMENTS 64-8356 2/1989 Japan .

*Primary Examiner*—Stanley J. Witkowski

[57] ABSTRACT

A key depression speed is measured in units of keys of a keyboard of an electronic musical instrument by a counter for counting clock pulses, and the measured value is converted into key touch data. Counters, the number of which is smaller than the total number of keys of the keyboard are used, and one count channel is assigned to two or more keys. When two keys assigned to the same count channel are successively depressed, the initial value of the corresponding count channel is set, so that an error of the measurement values sequentially obtained in correspondence with the key depression speeds of the keys is minimized.

13 Claims, 12 Drawing Sheets

KEY TOUCH DATA GENERATION CIRCUIT OF AN ELECTRONIC MUSICAL INSTRUMENT

BACKGROUND OF THE INVENTION

1. Field of the Invention

The present invention relates to a key touch data generation circuit in an electronic musical instrument and, more particularly, to a key touch data generation circuit suitably applied to a circuit for measuring a key depression speed using a counter.

2. Description of the Background Art

In an electronic musical instrument having a plurality of keys, touch data are obtained in units of keys, and the amplitude envelope, or the like of an output waveform of a digital tone source is controlled. The touch data is obtained in such a manner that two key switch contacts corresponding to different key depression depths are arranged for each key, and an operation time difference between the two key switch contacts is measured. The operation time difference is measured by a counter for counting clock pulses of a predetermined frequency.

Counters for detecting key touch data are normally arranged in one-to-one correspondence with keys. On the other hand, in some polyphonic electronic musical instruments, the number of simultaneous (parallel) tone generation channels of a digital tone source is considerably smaller than the total number of keys. In such an electronic musical instrument, the number of counters for detecting key touch data is smaller than the total number of keys (e.g., Japanese Patent Publication No. 64-8356).

In the electronic musical instrument in which the number of counters for detecting key touch data is small, key touch data cannot be generated if keys exceeding the number of counters are simultaneously depressed.

SUMMARY OF THE INVENTION

The present invention has been made in consideration of the conventional problem, and has as its object to provide a key touch data generation circuit which can detect touch data of depressed keys exceeding the number of counters without increasing the number of counters.

A key touch data generation circuit in an electronic musical instrument according to the present invention, comprises first and second key switches which are arranged for each key, and are sequentially operated at different depths of key depression; a counter circuit consisting of a plurality of counters in which one count channel is assigned in correspondence with at least two keys; counter value setting means, responsive to an operation of the first key switch, for setting a counter value of a count channel corresponding to an operated key and for then starting a count operation of the corresponding count channel; count value reading means, responsive to an operation of the second key switch, for reading a counter value of the count channel corresponding to the operated key; and touch data generation means for assigning the read count value to the operated key and for generating key touch data corresponding to a key depression speed of the key.

Since two or more keys can be assigned to one count channel, key depression speeds of keys can be detected using counters, the number of which is smaller than the total number of keys. Measurement errors caused by overlapped use of count channel by two keys can be reduced by presetting the counter initial value. Assignment of keys to the count channels can be determined to reduce the possibility of concurrent use of a count channel by two or more keys.

Further scope of applicability of the present invention will become apparent from the detailed description given hereinafter. However, it should be understood that the detailed description and specific examples, while indicating preferred embodiments of the invention, are given by way of illustration only, since various changes and modification within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
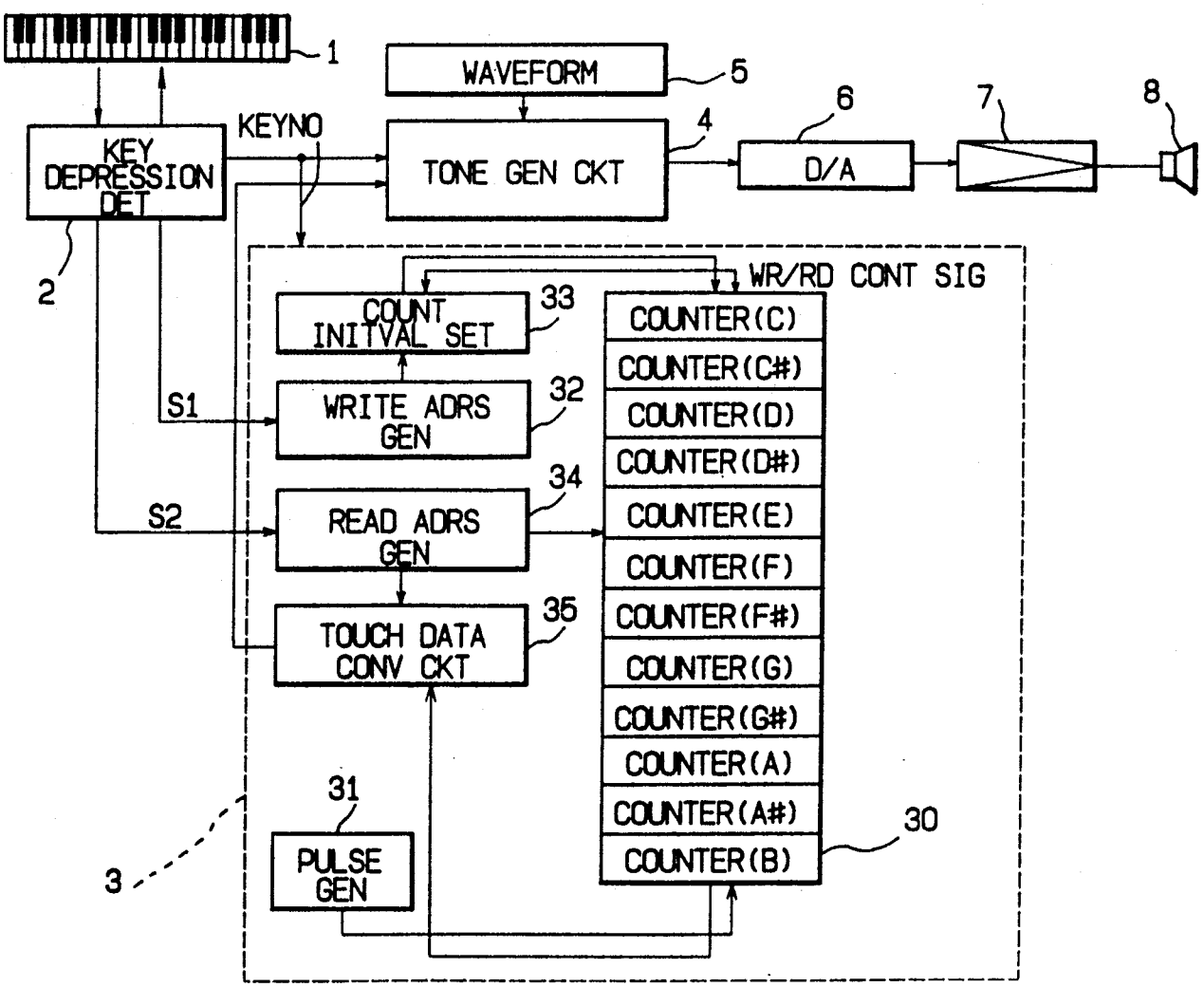
FIG. 1 is a block diagram showing a principal part of a key touch data generation circuit in an electronic musical instrument according to an embodiment of the present invention.

FIG. 1 is a block diagram showing a principal part of an electronic musical instrument according to the first embodiment of the present invention. A key depression detection circuit 2 is connected to a keyboard 1 consisting of a plurality of keys, and detects data such as a time between key ON and OFF events, a key number, a key depression speed, and the like. The key depression speed data is obtained as pulse outputs S1 and S2 from two key switch contacts corresponding to key depression depths. These pulse outputs are supplied to a touch data generation circuit 3, and the time width between the pulses S1 and S2 is measured by a corresponding counter. The count value is then converted into touch data.

A tone generation circuit 4 receives a key depression time width, a key number, and touch data from the key depression detection circuit 2 and the touch data generation circuit 3 as tone control signals, and controls the amplitude, envelope, tone duration time, and the like of PCM waveform data read out from a waveform ROM 5 on the basis of these tone control signals, and outputs a tone signal. The digital tone signal is converted into an analog audio signal by a D/A converter 6, and the analog audio signal is supplied to a loudspeaker 8 via an amplifier 7. Therefore, a piano tone, a guitar tone, and the like stored in the waveform ROM 5 are generated in correspondence with key operations of the keyboard 1.

The touch data generation circuit 3 comprises a counter circuit 30 corresponding to 12 channels. Each channel corresponds to 12 tones (C, C#, D, D#, E, . . . ) for one octave of the keyboard 1. A counter in each channel of the counter circuit 30 is used commonly to other octaves. The counter circuit 30 can be constituted by using, e.g., 12 data registers (or RAMs) in a CPU. An initial value is set in the counter constituting each channel in response to the first pulse S1 from the key depression detection circuit 2, and the counter then counts clock pulses output from a pulse generator 31. When the second pulse S2 is supplied from the key depression detection circuit 2, the counter outputs a count value.

The first pulse S1 supplied from the key depression detection circuit 2 starts a write address generator 32 in the touch data generation circuit 3. The write address generator 32 generates address data for selecting one of 12 counter channels of the counter circuit 30 on the basis of key number data KEYNO from the key depression detection circuit 2. The address data is supplied to a count initial value setting circuit 33, and a count initial value is written at the corresponding address position of the counter circuit 30 in accordance with the output from the count initial value setting circuit 33.

When the second pulse S2 is supplied from the key depression detection circuit 2, a read address generator 34 in the touch data generation circuit 3 is started. The read address generator 34 reads the count value of the counter at the corresponding address position at a timing of the pulse S2, and outputs the read value to a touch data converter 35.

The touch data converter 35 has a touch response table for reading out corresponding touch data using key depression speed data indicated by the count value as an input. The touch response table is formed in accordance with a predetermined response curve representing a correspondence between key depression speed data, and touch data (velocity data) for determining an initial amplitude of a tone waveform output to be formed by the tone generation circuit 4.

Touch data output from the touch data converter 35 is output to the tone generation circuit 4 together with key number data and key depression time width data, as described above.

Figure 2:
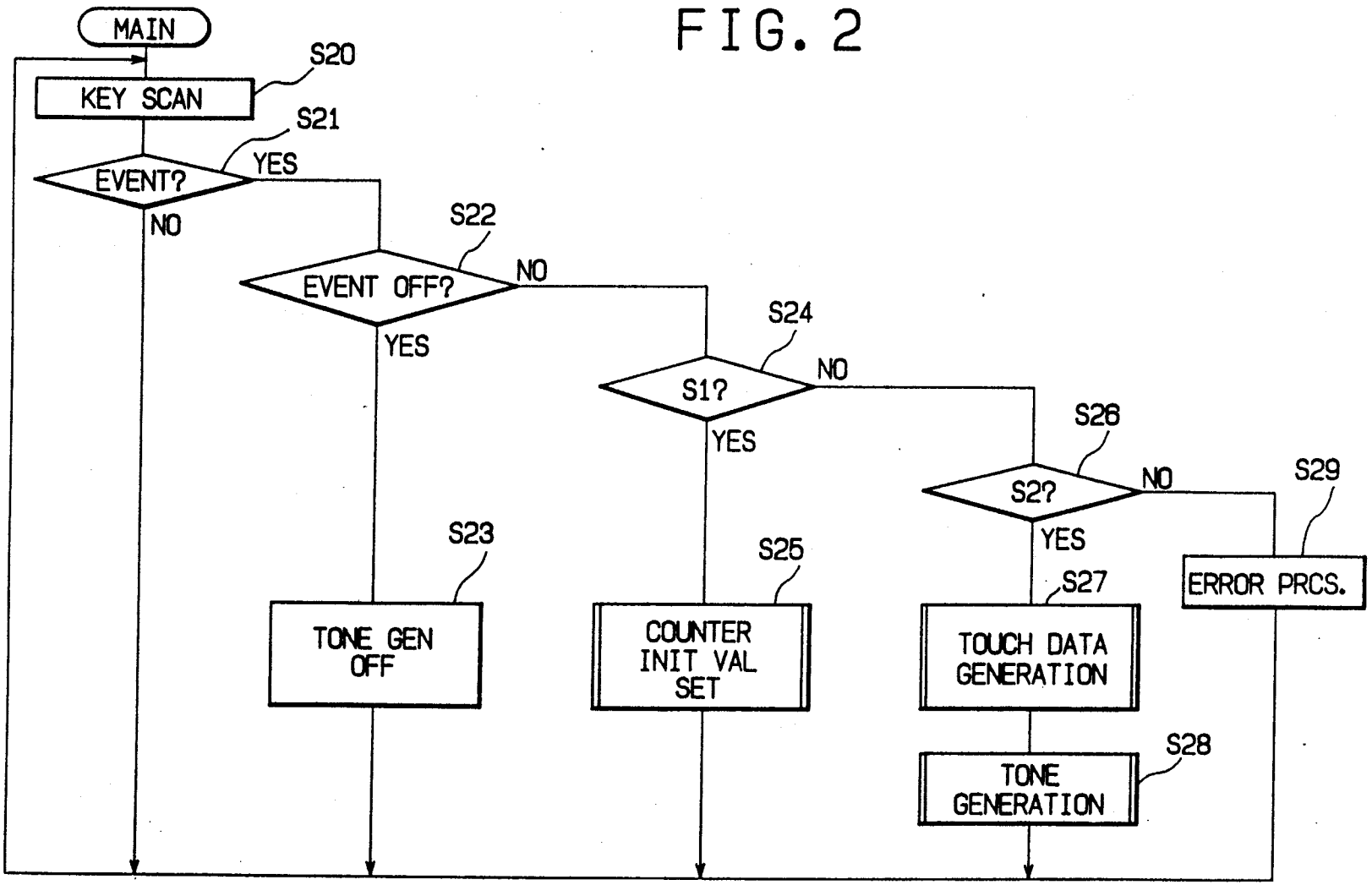
FIG. 2 is a main flow chart of a key operation.

FIG. 2 is a flow chart showing a processing flow of the touch data generation circuit 3 (CPU) upon a key depression operation. In step S20, a key scan routine is executed to detect operations of all the keys. When the operation of a given key is detected, it is checked in step S21 if an ON (key depression) event is detected, and it is then checked in step S22 if an OFF event (key release) is detected. In steps S24 and S26, it is checked if the key switch contacts S1 and S2 for detecting key depression speed data are operated. In the key scan routine in step S20 in FIG. 2, ON/OFF data of the contacts S1 and S2 are written in register areas allocated in correspondence with all the keys on the basis of a key scan interrupt routine executed at a predetermined time interval.

At the operation timing of the contact S1, counter initial value setting processing is executed in step S25. At the operation timing of the contact S2, touch data generation processing is executed on the basis of the read counter value in step S27. The flow then advances to step S28 to execute tone generation processing. In this processing, tone control signals including generated touch data (tone volume data), key number data, and the like are sent to the tone generation circuit 4, thus producing a tone corresponding to a depressed key.

If an OFF event (key release) is detected in step S22, tone generation off processing is executed in step S23. If it is determined in step S26 that the operation of the key switch contact S2 is not detected within a predetermined period of time, error processing is executed in step S29.

Figure 3:
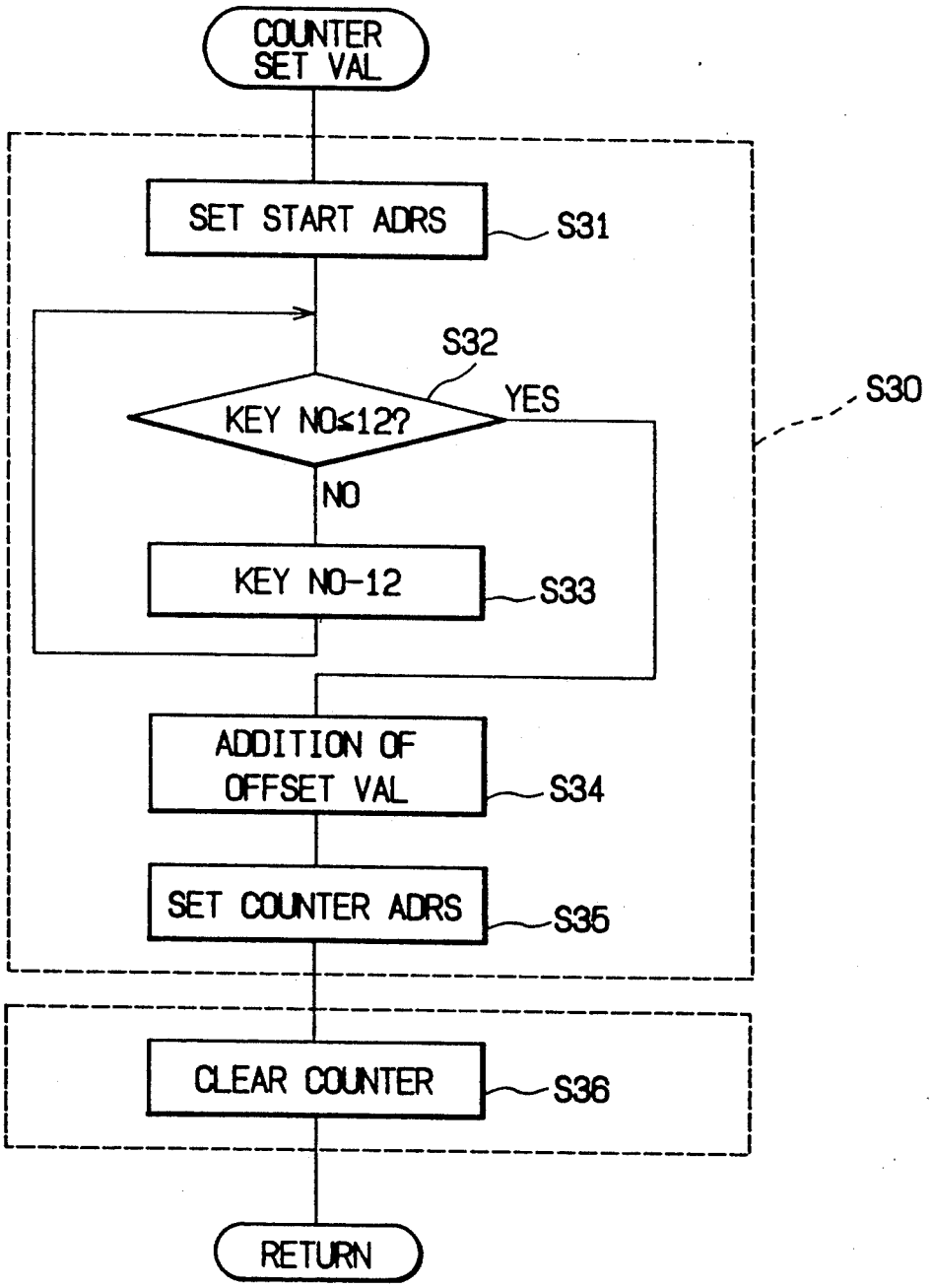
FIG. 3 is a flow chart showing counter value setting processing.

FIG. 3 is a flow chart showing counter value setting processing included in the counter initial value setting processing in step S25 in FIG. 2. In this embodiment, since the counter circuit 30 having 12 channels corresponding to one octave (FIG. 1) is commonly used by a plurality of octaves of the keyboard, an address offset processing routine S30 is executed to set common counter addresses for keys in the octaves. When the operation of the key switch contact S1 is detected, a register address of a counter (C) in the counter circuit 30 (FIG. 1) corresponding to C major is set in step S31. In step S32, it is checked if a key number KEYNO of the operated key is equal to or smaller than 12. If NO in step S32, an offset calculation for subtracting 12 from the key number KEYNO is performed in step S33. Note that the offset value of the C major counter is zero. The processing operations in steps S32 and S33 are repeated until the key number becomes equal to or smaller than 12.

Upon completion of the offset calculation, the offset value for assigning a key operated in any octave of the keyboard 1 to one of the 12 counters (C, C#, D, . . . , B) of the counter circuit 30 is obtained. An offset addition for adding the offset value to the address of the counter C is performed in step S34, and the obtained address is set in the corresponding address register in step S35. In step S36, the counter corresponding to the calculated address is cleared (set to be zero).

The cleared counter then counts clock pulses from the pulse generator 31. Thereafter, when the operation of the key switch contact S2 is detected, the count value of the corresponding counter is read.

Figure 4A:
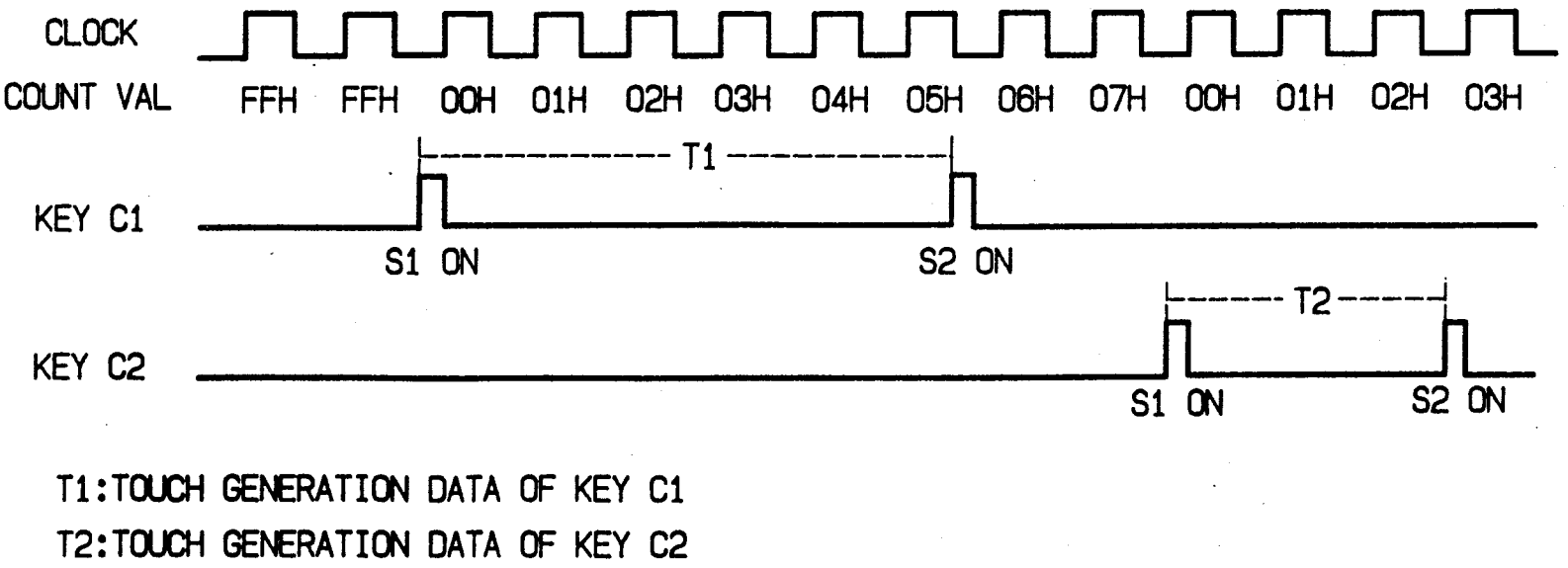
FIGS. 4A to 4C are timing charts of a key operation.

FIG. 4A is a timing chart of an operation performed when two keys which commonly use one count channel are operated in different time bands. As for a key C1, the corresponding counter is set to be 00H upon detection of the operation of the contact S1, and thereafter, its count value 05H (T1) is read upon detection of the operation of the contact S2. Similarly, as for a key C2, the corresponding counter is set to be 00H upon detection of the operation of the contact S1, and thereafter, its count value 02H (T2) is read upon detection of the operation of the contact S2. These values T1 and T2 are supplied to the touch data converter 35 (FIG. 1) as touch generation data, and are converted into touch data according to the touch response curve.

Figure 4B:
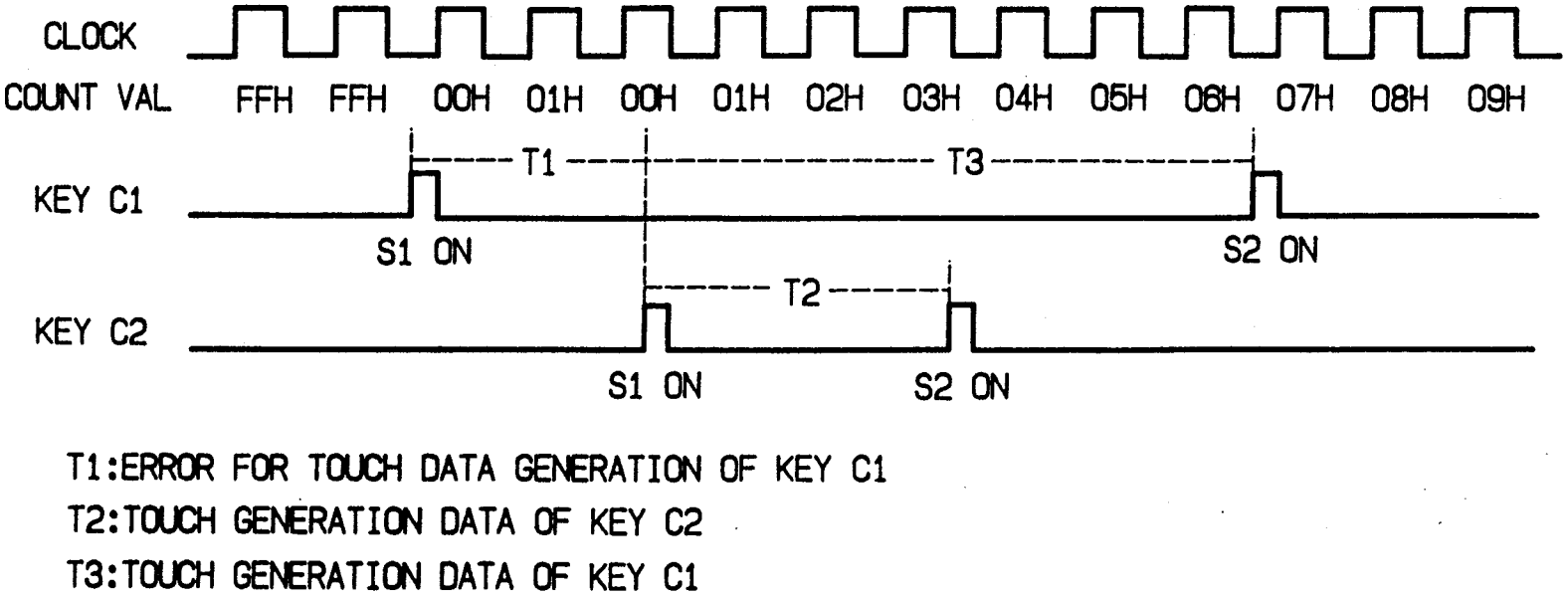
Figure 4C:
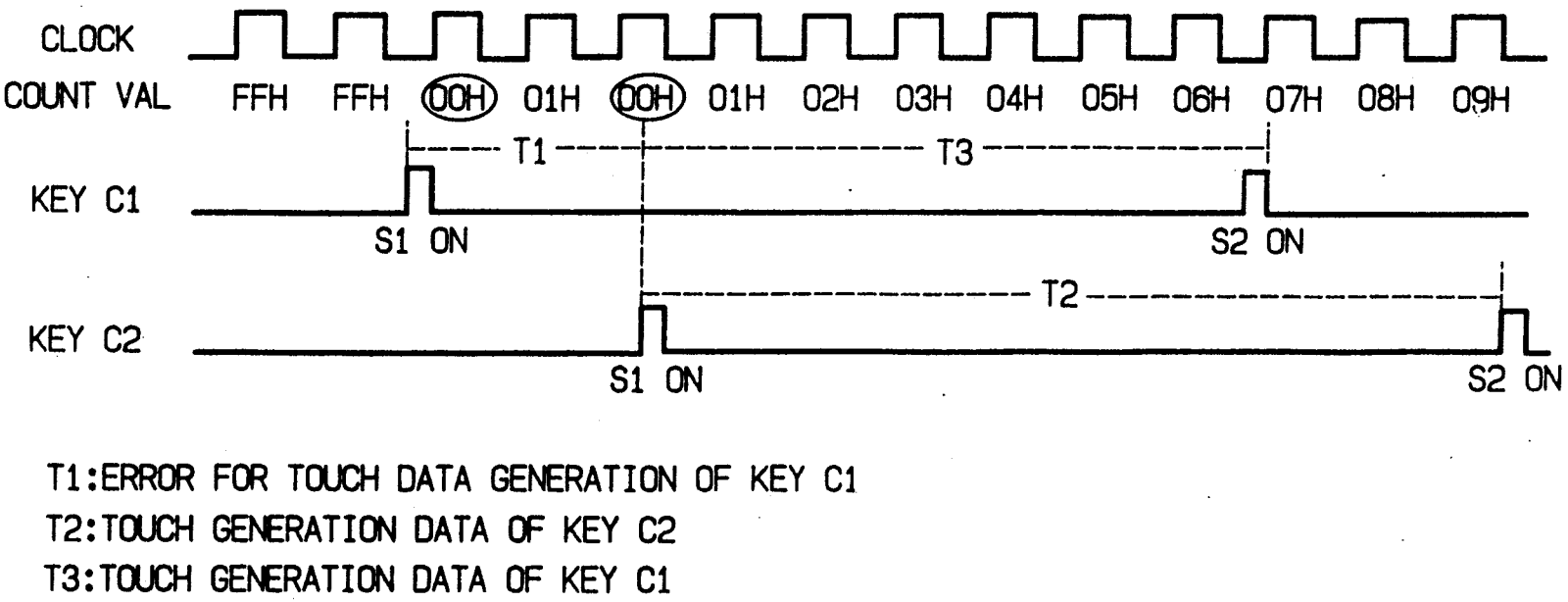

FIGS. 4B and 4C are timing charts of operations performed when two keys are simultaneously used and are assigned to the same counter channel. In this case, after the corresponding counter is set to be 00H upon detection of the operation of the key switch contact S1, the operation of another contact S1 is detected before detection of the operation of the corresponding key switch contact S2, and the counter is set to be 00H. Thereafter, when the operations of the key switch contacts S2 are sequentially detected, count values T2 and T3 at the corresponding timings are sequentially read, and are converted into touch data. These touch data are supplied to the tone generation circuit 4 together with the corresponding key numbers.

Therefore, in FIGS. 4B and 4C, a count value T1 until the second detection of the operation of the key switch contact S1 is cut off as a detection error for touch data of the key C1.

Figure 5:
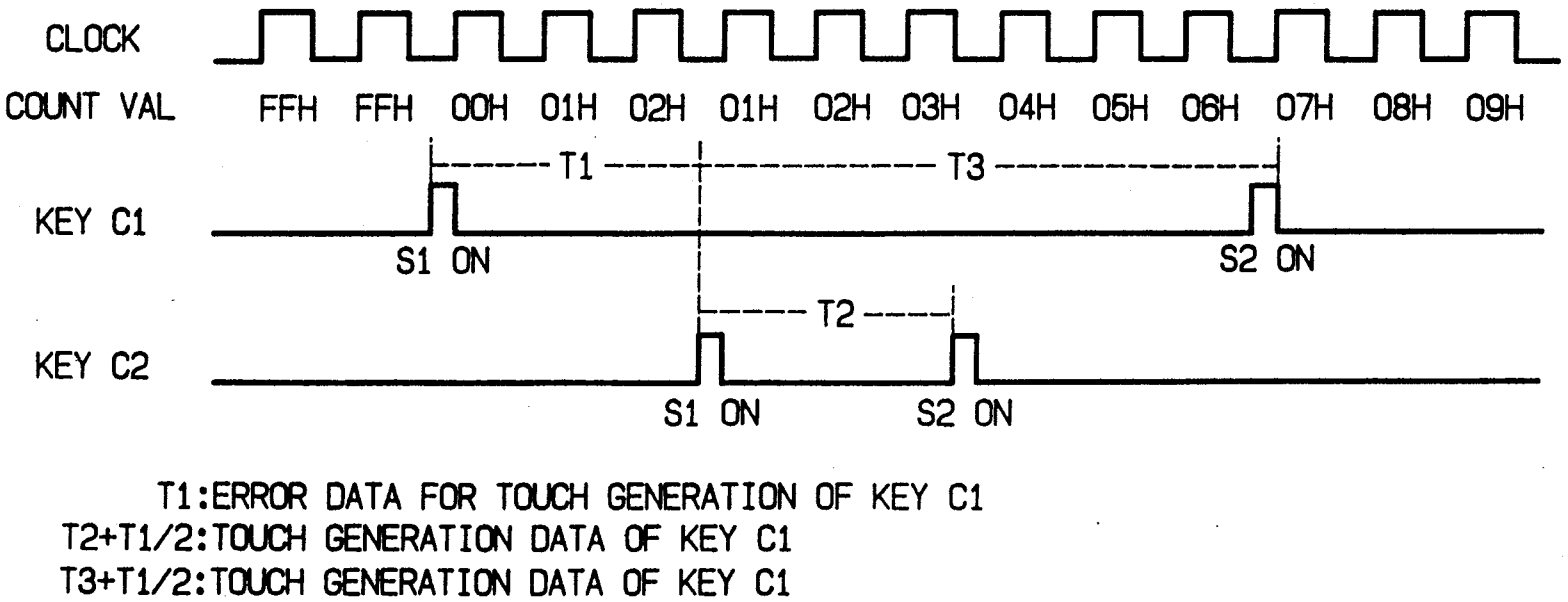
FIG. 5 is a timing chart of the key operation showing another count value setting processing.

FIG. 5 is a timing chart, similar to FIG. 4B, showing a modification of a processing when a count channel is simultaneously used. In FIG. 4B, the count value T1 is cut off as an error. However, in FIG. 5, the count value T1 (02H) is read upon second detection of the key switch contact S1, and a value ½ the read count value is set again in the counter as an initial value (01H) of the counter. Therefore, count values upon detection of operations of the key switch contacts S2 are given by T2+T1/2 and T3+T1/2, and the error T1 can be equally distributed to the detection values of key operation speeds, thus eliminating an error.

Figure 6:
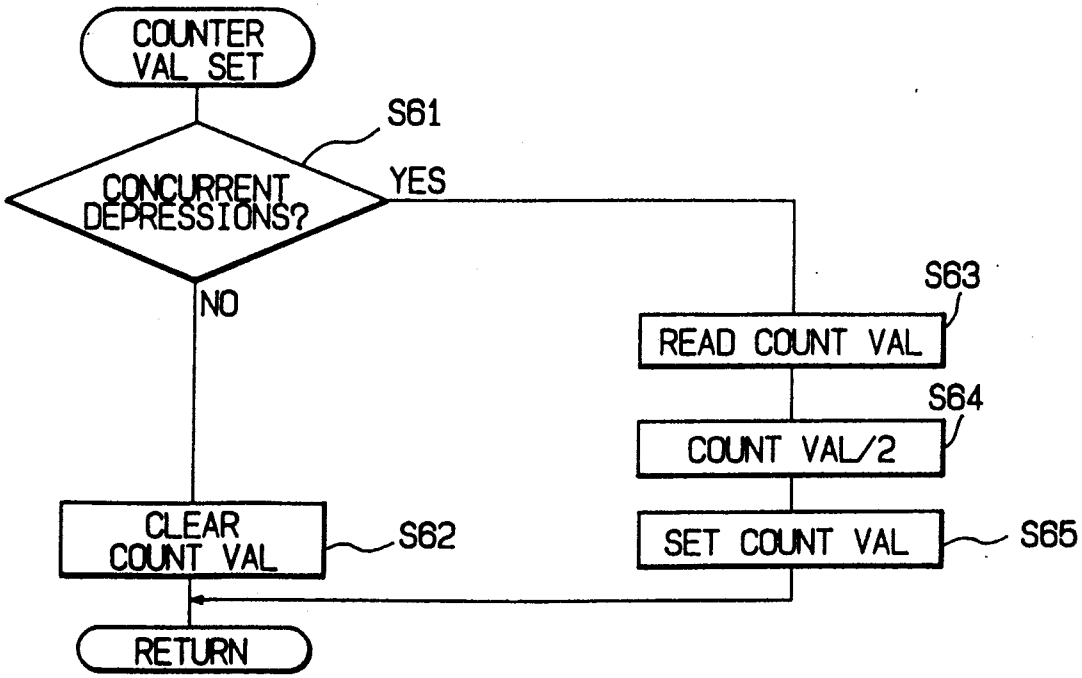
FIG. 6 is a flow chart showing another count value setting processing.

FIG. 6 is a flow chart of the above-mentioned error processing. In step S61, it is checked if two keys are concurrently depressed. If NO in step S61, the count value is cleared upon detection of the operation of the key switch contact S1, as shown in FIG. 4A. However, if YES in step S61, the flow advances to step S63, the count value upon detection of an ON event of another contact S1 is read, and a value ½ the read value is calculated in step S64. In step S65, the calculated value is set in the corresponding count channel as a count value. Therefore, the counter starts counting from 01H, as shown in FIG. 5, and every time the key switch contact S2 is operated, count values 03H and 06H are read in turn as key depression speed values.

Therefore, according to this embodiment, since key depression speeds are measured using different count channels in units of note names, even when a plurality of keys within one octave are concurrently used to produce ornaments or in a trill performance mode, different count channels can be assigned to these keys. In different octaves, the count channels are commonly used in units of note names. Thus, when the number of count channels is decreased to be smaller than the total number of keys, no problem is posed in key depression speed detection. In this case, although an error T1 or T1/2 occurs in key depression speed detection, as described above, since this error does not often occur, the performance will not be disturbed.

Figure 7:
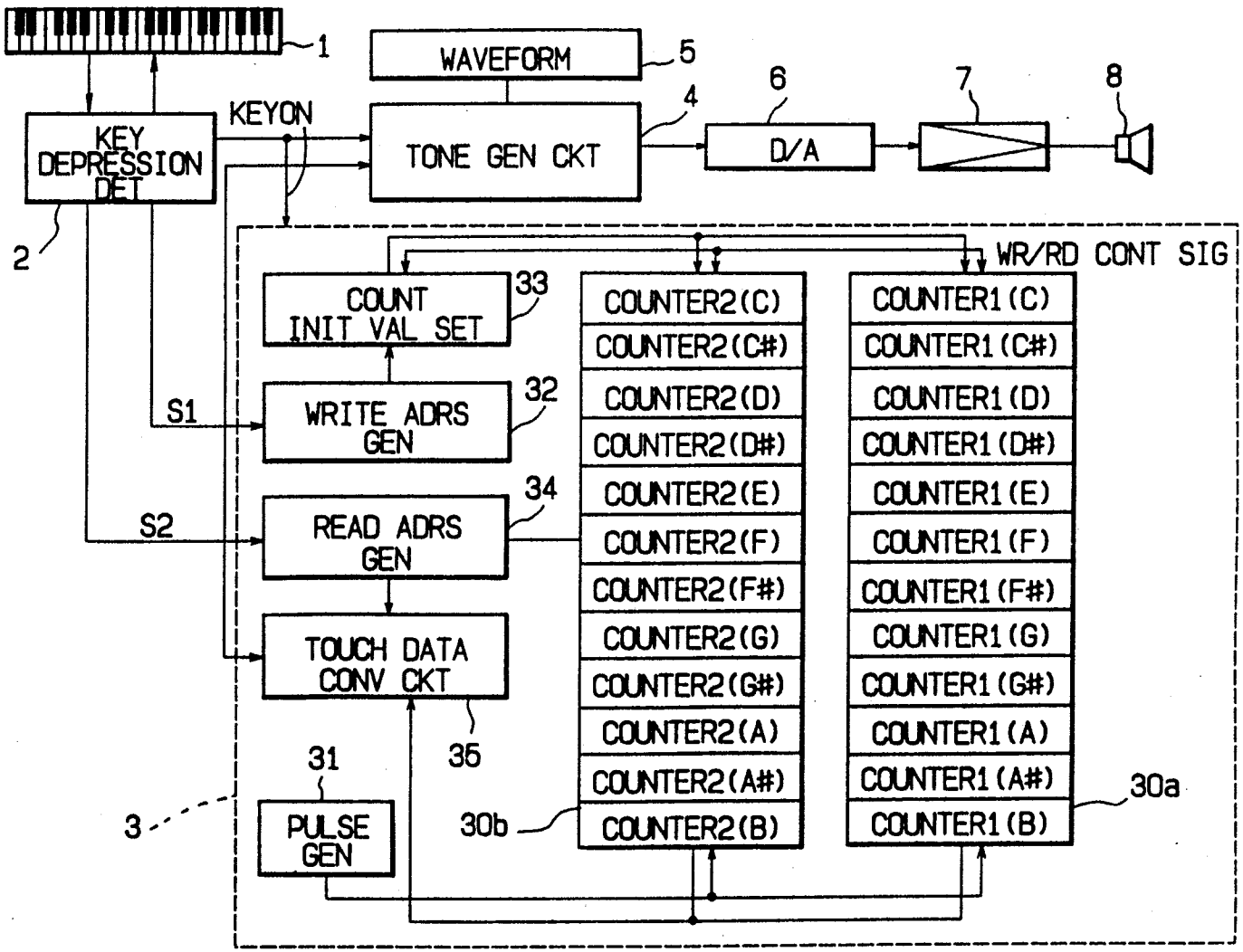
FIG. 7 is a block diagram showing a principal part of an electronic musical instrument, similar to that shown in FIG. 1, according to another embodiment of the present invention.

FIG. 7 is a block diagram showing principal part of an electronic musical instrument according to a second embodiment of the present invention. In this embodiment, a keyboard 1 is split into two regions corresponding to right and left hands, and independent counter circuits 30*a* and 30*b* (counters 1 and counters 2) are assigned to these regions. Each of the counter circuits 30*a* and 30*b* comprise counters (data registers) for 12 channels like in FIG. 1. Other arrangements are the same as those in FIG. 1, and the same reference numerals in FIG. 7 denote the same parts as in FIG. 1.

Figure 8A:
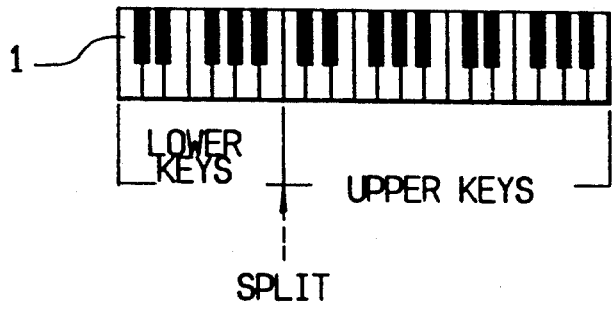
FIG. 8A is a view showing upper and lower regions of a keyboard.
Figure 8B:
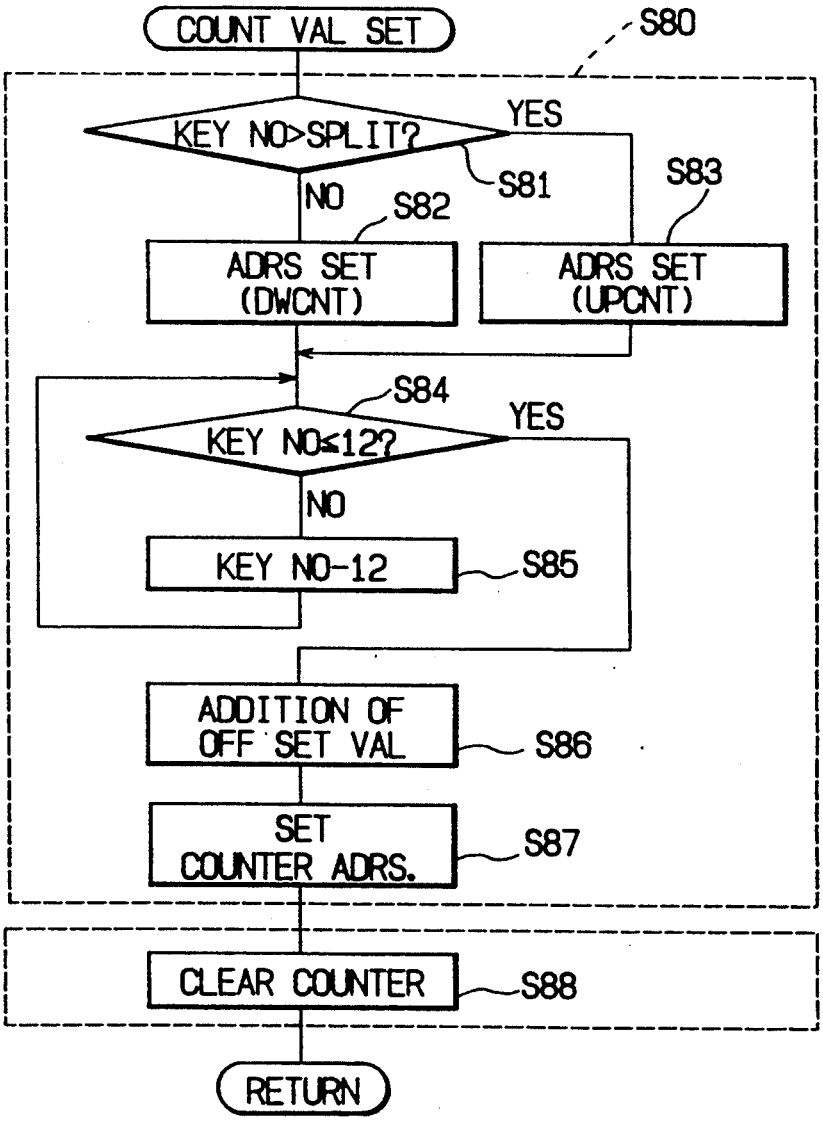
FIG. 8B is a flow chart showing counter value setting processing in the embodiment shown in FIG. 7.

As shown in FIG. 8A, the keyboard 1 is split into upper and lower key regions to have a split point SPLIT as a boundary. The counter circuits 30*a* and 30*b* assigned to these regions are commonly used by a plurality of octaves in the two regions in the same manner as in the first embodiment. Counter value setting processing of the counter circuits 30*a* and 30*b* is executed, as shown in the flow chart of FIG. 8B. In an address offset processing routine S80, it is checked in step S81 if the number KEYNO of the operated key is larger than the split point SPLIT. If the key number belongs to the lower key region, a start address DWCNT of the counter register of the count circuit 30*a* is set in step S82. On the other hand, if the key number belongs to the upper key region, a start address UPCNT of the counter register of the counter circuit 30*b* is set in step S83. In steps S84 to S87, the same offset processing as in FIG. 3 is executed, and in step S88, the counter value is cleared.

Therefore, in this embodiment, even when the right and left hands are simultaneously used, since key depression speeds are independently detected in units of regions corresponding to the right and left hands, speed detection can be performed without causing an error. In each of the upper and lower key regions, since the count channels are assigned in units of note names, and are commonly used among octaves, key depression speed detection can be performed using the count channels, the number of which is smaller than the total number of keys, like in the first embodiment.

Figure 9:
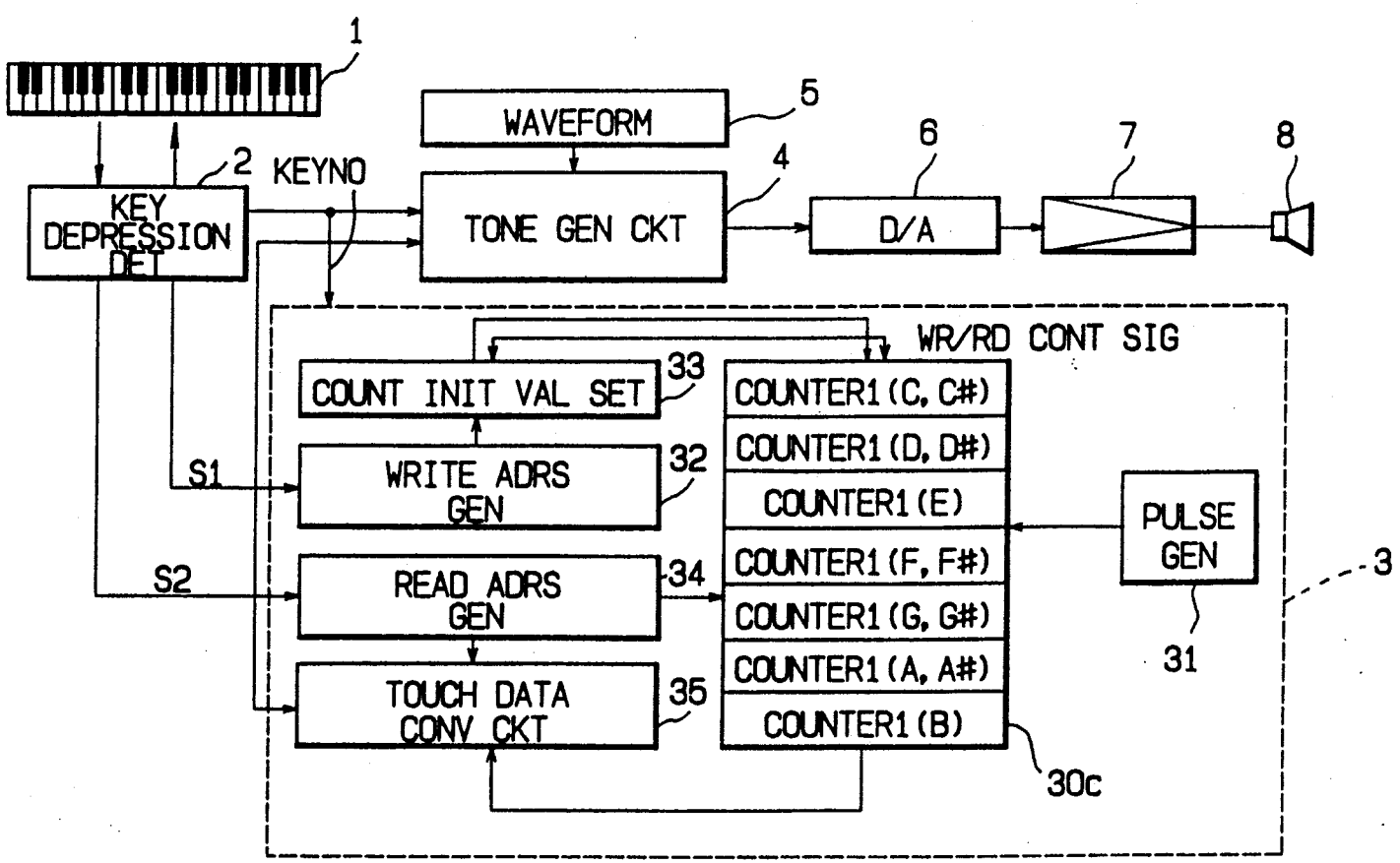
FIG. 9 is a block diagram showing a principal part of an electronic musical instrument according to still another embodiment of the present invention.

FIG. 9 is a block diagram showing principal a part of an electronic musical instrument according to a third embodiment of the present invention. In this embodiment, count channels are commonly used in units of note names among octaves, and each pair of adjacent black and white keys commonly use one count channel. More specifically, in a count circuit 30*c*, keys corresponding to C and C#, D and D#, F and F#, G and G#, and A and A# use the same count channels. Therefore, key depression speeds of all the keys can be measured using seven count channels. In general, since adjacent black and white keys are not often simultaneously used, common use of the count channels does not pose a serious problem.

Figure 10:
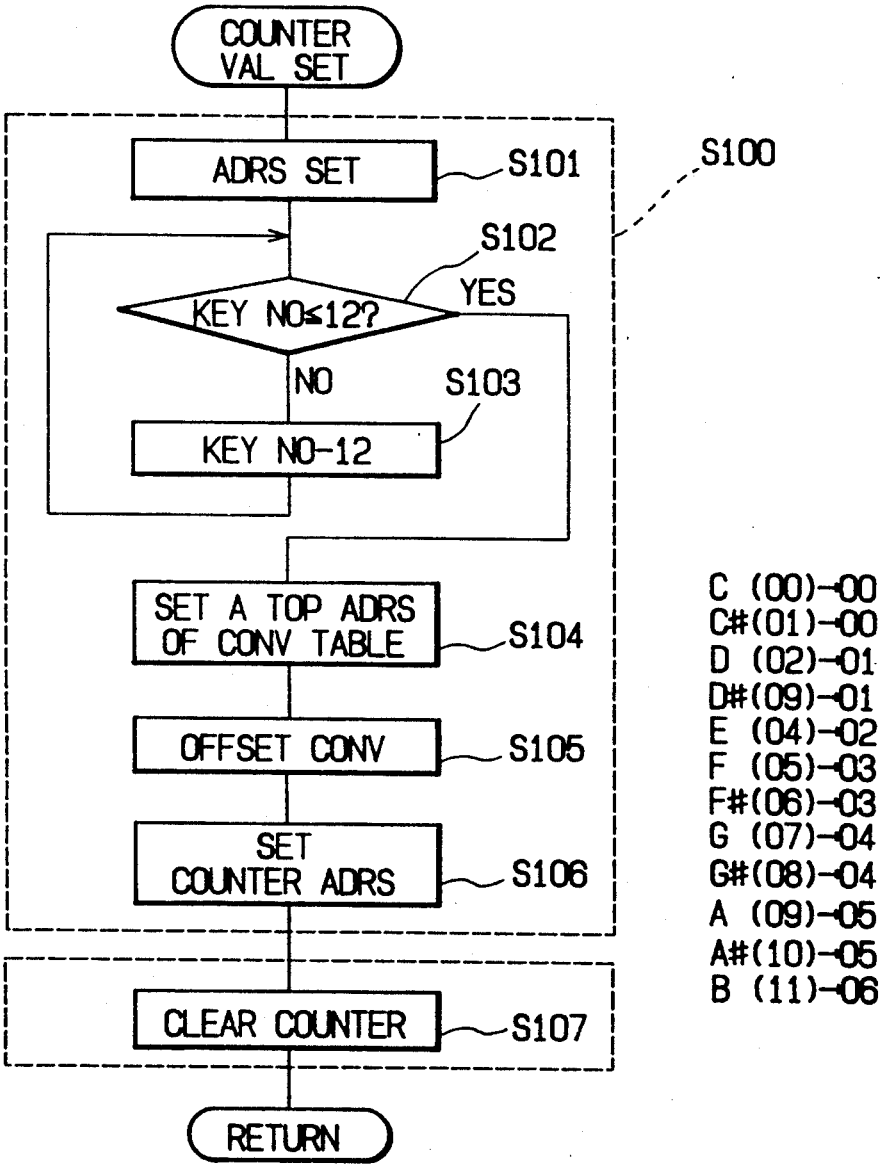
FIG. 10 is a flow chart showing counter value setting processing in the embodiment shown in FIG. 9.

FIG. 10 is a flow chart of counter value setting processing corresponding to the embodiment shown in FIG. 9. An address offset processing routine S100 in this embodiment is performed in substantially the same manner as in FIG. 3. That is, after the start address of the counter circuit 30*c* is set in step S101, an offset value of key numbers between octaves is calculated in steps S102 and S103. In conversion top address setting processing in step S104, a start address C (00) of an offset conversion table shown on the right side in FIG. 10 is set, and a corrected offset value is read out from the conversion table on the basis of the offset value calculated in steps S102 and S103. The same corrected offset value is used for adjacent black and white keys. In step S105, the corrected offset value is added to the start address of the counter circuit 30*c*. In step S106, an address of one of the seven registers of the counter circuit 30*c* is set. In step S107, the value of the corresponding count channel is set (cleared) to be zero.

Therefore, in this embodiment, key depression speeds corresponding to all the keys can be detected using the seven count channels. Note that error processing due to common use of the count channels is performed in the same manner as in FIGS. 4B and 4C or FIG. 5.

In each of the above embodiments, the channels may be assigned on the basis of a correspondence table between key numbers of all the keys and the addresses of the count channels. In this case, the address offset processing shown in FIGS. 3, 8B, and 10 can be replaced with table look-up processing.

According to the present invention, as described above, since two or more keys are assigned to each count channel of a counter circuit for measuring a key depression speed, key depression speeds of a larger number of key operations can be detected using a smaller number of counter channels. When one count channel is active, if another key which commonly use the active channel is operated, the count value of the count channel is set again. Therefore, even when one count channel is simultaneously used by two key operations, a count error can be minimized.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

What is claimed is:

1. A key touch data generation circuit in an electronic musical instrument, comprising:

first and second key switches arranged in units of keys, and sequentially operated at different depths of key depression;

a counter circuit consisting of a plurality of counters, wherein each of said counters are assigned to a count channel and wherein each of said count channels are assigned to at least two keys;

counter value setting means, responsive to an operation of one of said first key switches, for setting a counter value of a respective counter of said count channels which corresponds to an operated key to a predetermined value and for starting a count operation of said respective counter of said count channels;

counter value reading means, responsive to an operation of a corresponding one of said second key switches, for reading a counter value of said respective counter of said count channels which corresponds to the operated key; and touch data generation means for assigning the read counter value to the operated key and for generating key touch data corresponding to a key depression speed of the operated key.

2. The key touch data generation circuit according to claim 1, wherein each of said count channels of said counter circuit is assigned to a plurality of keys having different intervals and the same note name.

3. The key touch data generation circuit according to claim 1, wherein said counter circuit comprises two count channel groups arranged in correspondence with two regions split in a key aligning direction of a keyboard, each of said count channels in each of said count channel groups being assigned to at least two keys.

4. The key touch data generation circuit according to claim 1, wherein each of said count channels of said counter circuit is assigned to a plurality of keys having different intervals and the same note name, and to adjacent black and white keys.

5. The key touch data generation circuit according to claim 1, wherein an initial counter value set in said counters of said count channels in response to the operation of said first key switches is zero.

6. The key touch data generation circuit according to claim 1, wherein said counter value setting means comprises:

discrimination means for discriminating that successive operation of said first key switches corresponding to operations of at least two keys assigned to one of said count channels have occurred before the operation of corresponding ones of said second key switches; and setting means, responsive to a later successive operation of one of said first key switches, for reading a counter value of the one of said count channels and for setting a new counter value ½ the read counter value as an initial counter value of the one of said count channels.

7. The key touch data generation circuit according to claim 1, wherein said counter value setting means further comprises pulse generation means for generating a specific clock frequency which is counted by said counters.

8. A method of generation key touch data in an electronic musical instrument comprising the steps of:

generating respective first and second key signals from a plurality of first and second key switches, respective pairs of the first and second key switches being arranged to generate the first and second key signals for different respective keys of the electronic musical instrument, the first key signal being generated in accordance with a first depth of depression of a key and the second signal being generated in accordance with a second depth of depression of a key, which is greater than the first depth of depression;

generating count values in counter means for a respective key, the counter means including a plurality of counters, wherein plural respective keys are assigned to each of the counters, said count value generating step including the steps of setting an initial counter value in a respective counter in accordance with receipt of a corresponding first key signal from the respective key, counting clock pulses generated by clock pulse generating means in the respective counter, and reading out a final count value of the respective counter, for the respective key, upon receipt of a corresponding second key signal; and generating key touch data, in touch data conversion means, for the respective key in accordance with the final count value.

9. The method of generating key touch data according to claim 8, wherein each of the counters are assigned to plural respective keys having different intervals and the same note name.

10. The method of generating key touch data according to claim 8, wherein the counter means comprises two groups of the counters which are arranged in correspondence with two regions split in a key aligning direction of a keyboard of the musical instrument, each of the counters of each of the two groups of the counters being assigned to at least two keys.

11. The method of generating key touch data according to claim 8, wherein each of the counters are assigned to plural respective keys having different intervals and the same note name, and to adjacent black and white keys.

12. The method of generating key touch data according to claim 8, said step of generating count values further comprising the step of setting the initial counter value to zero.

13. The method of generating key touch data according to claim 8, wherein said step of generating count values further comprises the steps of:

discriminating, in discrimination means, the successive receipt of the first key signals, before receipt of the corresponding second key signals, from different respective keys assigned to a same respective counter; and setting the initial counter value in the same respective counter, in response to receipt of the later successive first key signal, to a value ½ the counter value of the same respective counter when the later successive first key signal is received.

* * * * *